United States Patent [19]

Håkansson et al.

[11] Patent Number: 4,904,233

[45] Date of Patent: Feb. 27, 1990

[54] ARRANGEMENT IN A HEARING AID DEVICE

[76] Inventors: Bo Håkansson, Splintvedsgatan 7, S-416 80 Gothenburg; Peder Carlsson, Rosensköldsgatan 11, S-412 58 Gothenburg, both of Sweden

[21] Appl. No.: 136,456

[22] Filed: Dec. 21, 1987

Related U.S. Application Data

[63] Continuation of Ser. No. 861,508, May 9, 1986, abandoned.

[30] Foreign Application Priority Data

May 10, 1985 [SE] Sweden ..... 8502341

[51] Int. Cl.[4] ..... H04R 25/00

[52] U.S. Cl. ..... 600/25; 128/419 R

[58] Field of Search ..... 128/1 R, 421, 422, 419 R, 128/785; 179/107 BC; 600/25; 381/68, 68.3, 69; 151/129, 130, 134, 135

[56] References Cited

U.S. PATENT DOCUMENTS

| | | | |
|---|---|---|---|
| 2,402,392 | 6/1946 | Goldschmidt | 179/107 BC |
| 4,380,689 | 4/1983 | Giannetti | 179/107 BC |
| 4,495,917 | 1/1985 | Byers | 128/419 R |
| 4,498,461 | 2/1985 | Hakansson | 179/107 BC X |
| 4,596,903 | 6/1986 | Yoshizawa | 179/107 BC X |

*Primary Examiner*—Max Hindenburg
*Assistant Examiner*—J. P. Lacyk
*Attorney, Agent, or Firm*—Balogh, Osann, Kramer, Dvorak, Genova & Traub

[57] ABSTRACT

The present invention relates to an arrangement in a hearing aid comprising an oscillator apparatus, which via a coupling portion can be connected and anchored to the skull bone of a person with impaired hearing ability, said apparatus serving the purpose of an emitter for mechanical transmission of sound information to the skull bone.

6 Claims, 2 Drawing Sheets

Figure 1:
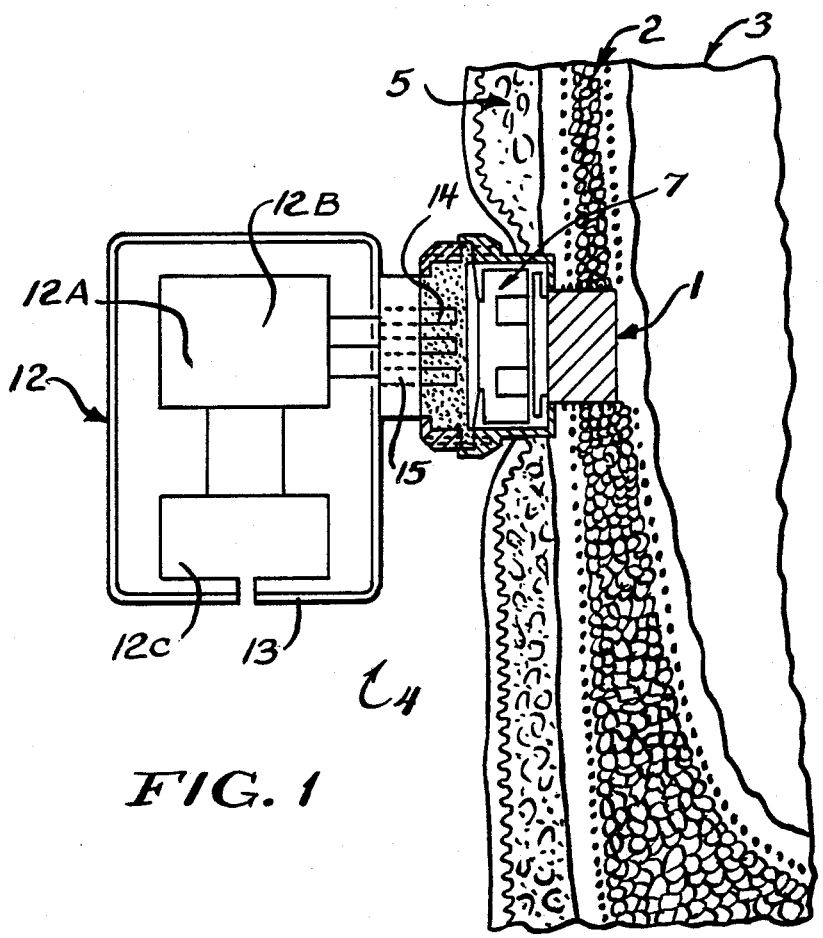

FIG. 2
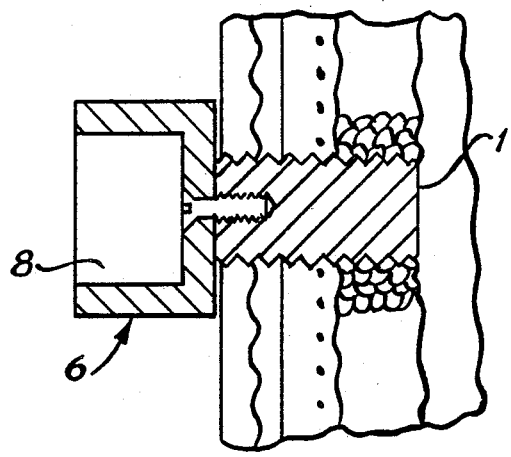
FIG. 3
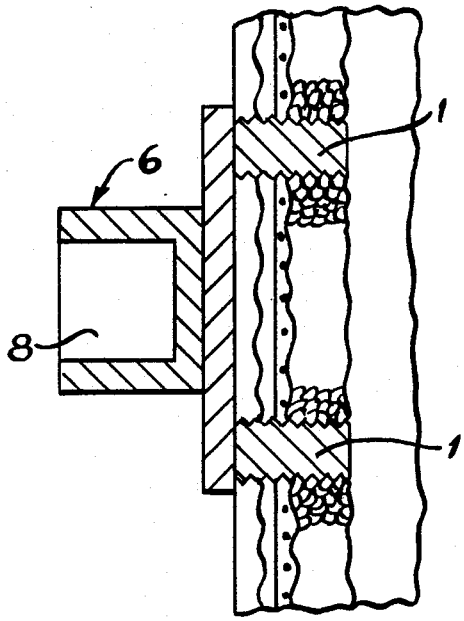
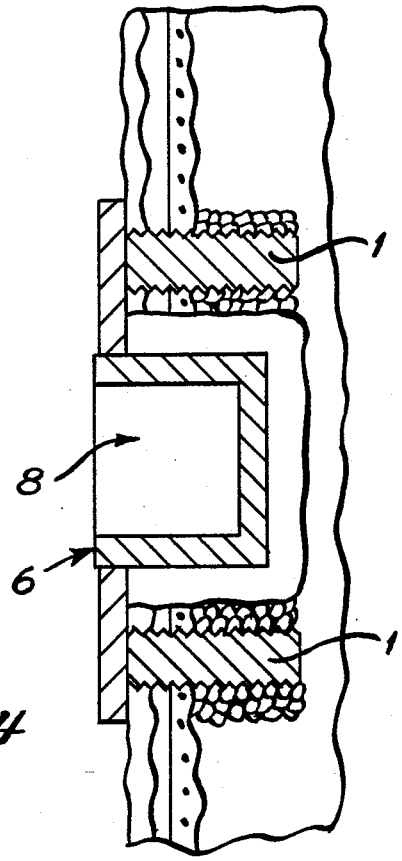
FIG. 4

ARRANGEMENT IN A HEARING AID DEVICE

This application is a continuation of application Ser. No. 861,508, filed May 9, 1986, abandoned.

The present invention relates to an arrangement in a hearing aid device comprising an oscillator apparatus, which via a coupling portion can be connected and anchored to the skull bone of a person with impaired hearing ability, said apparatus serving the purpose of an emitter for mechanical transmission of sound information to the skull bone.

For individuals suffering from impaired hearing and therefore having to recur to the use of an hearing aid, but because of exhibiting injuries of a type, which makes it impossible or note advisable to use hearing aids of the conventional kind, which present the amplified pressure of the sound in the auditory canal, there exits the possibility of using such hearing aids, which operate with an oscillator, a so called bone guide, which mechanically transmits the sound information to the skull bone of the person. Conventional bone guides of the prior art among other things comprising an oscillator, which by means of a separate clamp of steel or a pair of spectacle frames is pressed to the skin of the person, by way of example to the part behind the ear, among other things exhibit drawbacks as regards the static pressure arising on the skin from the effect of the oscillator on the outaneous tissue, which is perceived as an unpleasant feeling. Such arrangement is moreover considered as bulky and unaesthetical among other things because of the fact that the microphone and the oscillator forming part of the hearing aid assembly are placed on the opposite side of the skull in order to avoid accoustic selfoscillation. Also, hearing aids of the prior art of recent design of the type comprising anchoring means for a portion of the hearing aid to the skull bone of the person in question, by way of example hearing aids of the kind known from the SE B 8107161-5, exhibit drawbacks in the first place with regard to the size of the external portion of the hearing aid and also because of selfoscillation causing problems, when the person uses a cap or when he sleeps with the apparatus applied.

Thus, it is a principal object of the present invention to make possible a reduction of the volume of the portion of the hearing aid located outside of the cranium of the user and to lessen the problems of self-oscillation in connection with hearing aids of the last mentioned type, that can be anchored to the bone.

Said object is reached by means of an arrangement according to the present invention, which is substantially characterized by at least the portion of the hearing aid device comprising the device that generation the oscillations being anchored in close connection to the skull bone, so that said portion can be dismantled easily and be arranged in such a manner that via said coupling portion, which can be implanted in the skull bone, it can directly transmit the sound information to the skull bone.

Figure 1A:
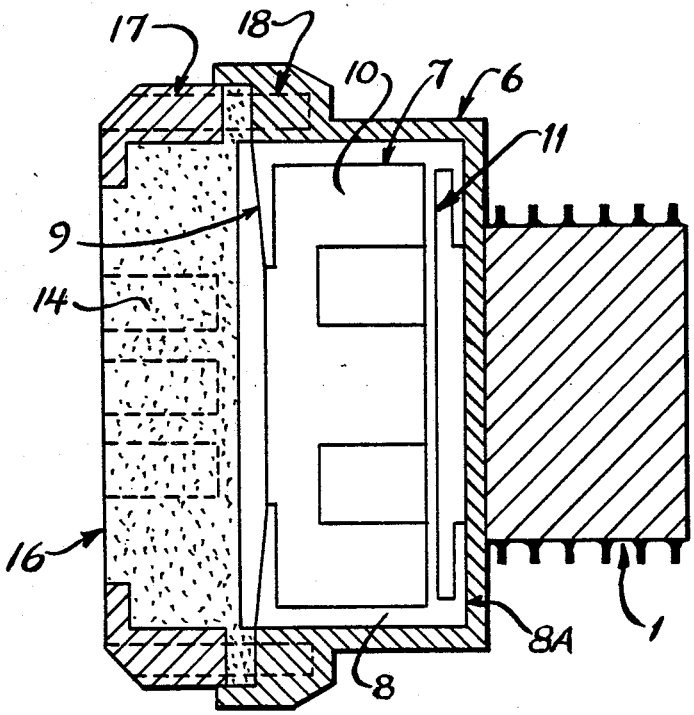

The invention is described below in the form of a preferred embodiment, reference being made to the drawings, in which FIG. 1 shows a cross section through a portion of a skull and a hearing aid connected to the same, FIG. 1A is an enlarged view of the portion of the hearing aid, which can be anchored to a skull bone and in FIG. 1 is enclosed in a circle, and FIG. 2–4 show variants of imaginable anchoring portions of hearing aids.

By means of one or more coupling portions 1 made of titanium material or other matreial compatible with the body of the user and by way of example of known type, which can preferably be implanted in the temporal bone 2 of the skull 3 of the person, who intends to use a bone anchored hearing aid 4 generating oscillations and serving the purpose of an emitter according to the present invention, it is made possible to connect the hearing aid 4 in a convenient manner with resultant good quality of sound, the surrounding skin 5 around the coupling portion 1 being penetrated.

At least the portion of said hearing aid 4 comprising an oscillator 7 arranged for providing a mechanical sound information to the skull bone 2 can be integrated i.e. being rigidly connected with a unit 6, or preferably received in said unit 6, which is detachably connected with said coupling portion 1, so that said oscillator can be firmly anchored close to the skull bone 2, but for the safety of the patient and for the serviceability can be easily detachable. Said unit 6 can suitably comprise a sleeve-shaped part extending in the direction away from the skull bone 2 through the skin 5 of the person, said part by way of example exhibiting an interior cavity 8, in which said oscillator 7 is arranged to be received. Also other parts belongong to the hearing aid 4 may possibly be enclosed in said cavity 8.

The firmly anchored part 7 of the hearing aid 4, which generates the oscillations, can by way of example be formed by a magnet including bobbin and coil 10 suspended by means of a number of springing means 9, said magnet being arranged to be actuated in such a manner that it can act in the direction towards a bottom 8A of said cavity 8, which bottom 8A can face the skull bone 2 of the user in order to cooperate with a stop part 11, which is connected with the coupling portion 1 in order to directly transmit mechanical sound generating and sound informing oscillations to the skull bone 2 of the person in question via said coupling portion for example in axial direction. The direction of translation and/or rotation of the oscillator can be optionally directed in relation to the perpendicular to the surface of the skull bone, if so desired. Also other oscillators than said electro-dynamic type can be used, by way of example piezoelectric and magnetostriction ones.

The remaining portion 12 of the hearing aid 4, i.e. the external portion of the apparatus, which is not enclosed in the cavity 8 and by way of example comprises a battery portion 12A, an amplifier 12B and a microphone 12C with connections and possibly other details belonging thereto, which can be enclosed in a casing 13 of for example plastic material, can be detachably coupled to said oscillator unit 7 of the hearing aid 4, by way of example via a number of electrically operating coupling means 14, 15 of a suitable type, by way of example of the plug-in type.

The oscillator 7 in situ is easily detachable in connection with the coupling portion 1 and/or 6, by way of example after a small cut of the skin has been made along the same, or directly without having to effect the skin 5 chirurgically.

A lid 16 by way of example of plastic material may comprise a number of said electrical coupling means 14 and may suitably be detachably connected with the sleeve-shaped portion 6 by way of example via a number of fastening screw or other connecting means, which cooperate with suitably distributed fastening holes 17, 18 around the periphery of the lid 16 and the sleeve portion 6.

Thanks to said firm anchoring of the whole hearing aid 4 or portion of the same of the type with direct mechanical transmission of the sound information without intermediate couplings being necessary, by way of example according to SE, B 8107161-5 and by the oscillator unit 7 of the hearing aid being firmly anchored to the skull 3, it is made possible to solve the inherent drawbacks of other hearing aids of the prior art and the anchoring means for them. It has been possible to substantially reduce the size of the external portion 12 of the hearing aid 4, so that it will be next to unnoticeably visible for the people surrounding the person, and problems of self-oscillation arising, when persons equipped with said hearing aid 4 have used a headgear or been sleeping with the hearing aid 4 applied, have been substantially reduced, and these important features are among others obtained by means of the invention.

It is by way of example made possible to implant several coupling portions 1 in the skulls bone 2 and connect said portions with each other by means of a connecting means functioning as a bridge of a kind by way of example similar to the kind indicated above, and as by way of example is shown in FIGS. 3 and 4.

The implanting of the coupling portion 1 in question in the skull bone 2 is suitably made as a first step, whereafter the surrounding skin 5 is left to heal, before an opening is by way of example made in the skin in order to fasten and/or connect the unit 6 in question and the oscillator 7 respectively, as has been described above, to the coupling portions 1.

The invention is not limited to the example of embodiment of a hearing aid device described above and illustrated in the drawings, but can be varied within the scope of the claims without departing from the fundamental idea of the invention.

What is claimed is:

1. Hearing aid apparatus for mechanical transmission of sound information from a sound-generating apparatus to the skull bone of a hearing impaired person, comprising a fixture means (1) made of a material compatible with the body of a person, means adapted for anchoring said fixture means to the skull bone of the wearer, a housing means including an interior cavity (6) anchored to said fixture means and extending in a direction away from the skull bone through the skin of the wearer, an oscillator means (7) releasably disposed within said interior cavity of said housing means for producing mechanical vibration of said information to the skull of the weares in response to electrical signals, a lid for said housing means, a first electrical connecting means in said lid for connecting to said oscillating means, and a casing, having a microphone, and an amplifier, and a battery power supply interconnected and disposed within said casing and being connected to a second electrical connecting means, said first and said second electrical connecting means being adapted to be releasably interconnected.

2. Hearing aid apparatus as claimed in claim 1, wherein said first and second electrical connecting means are of a plug-in type.

3. Hearing aid apparatus as claimed in claim 1, wherein said oscillator means is disposed to transmit vibrations toward the bottom (8A) of said housing means (6).

4. Hearing aid apparatus as claimed in claim 1, wherein said oscillator means (7) comprises a magnet suspended by a spring means (9).

5. Hearing aid apparatus as claimed in claim 1, wherein said fixture means is formed of titanium.

6. Hearing aid apparatus as claimed in claim 1, wherein said lid (16) of said housing means (6) is disposed outside of the body of the user and it not covered by the user's skin, when the apparatus is properly installed.

* * * * *